US007481070B2

(12) United States Patent
Costanzo

(10) Patent No.: US 7,481,070 B2
(45) Date of Patent: Jan. 27, 2009

(54) SOLAR POWERED CHILLED COOLER

(76) Inventor: Phillip E. Costanzo, 331 Bennett St., Wrentham, MA (US) 02093

( * ) Notice: Subject to any disclaimer, the term of this patent is extended or adjusted under 35 U.S.C. 154(b) by 331 days.

(21) Appl. No.: 11/279,785

(22) Filed: Apr. 14, 2006

(65) Prior Publication Data

US 2007/0240442 A1 Oct. 18, 2007

(51) Int. Cl.
*F25B 27/00* (2006.01)

(52) U.S. Cl. ..... 62/235.1; 62/457.7

(58) Field of Classification Search ..... 62/235.1, 62/457.1–457.9

See application file for complete search history.

(56) References Cited

U.S. PATENT DOCUMENTS

| | | | | |
|---|---|---|---|---|
| 4,281,515 | A | 8/1981 | Ferriera | |
| 4,367,633 | A * | 1/1983 | Strathman | 62/236 |
| 4,703,629 | A | 11/1987 | Moore | |
| 4,981,019 | A * | 1/1991 | Hicks et al. | 62/3.62 |
| 5,153,561 | A * | 10/1992 | Johnson | 340/571 |
| 5,379,596 | A * | 1/1995 | Grayson | 62/3.62 |
| D407,609 | S | 4/1999 | Rausch | |
| 5,987,891 | A | 11/1999 | Kim et al. | |
| 6,021,642 | A * | 2/2000 | Guinn | 62/3.6 |
| 6,134,902 | A * | 10/2000 | Curry | 62/236 |
| 6,305,185 | B1 | 10/2001 | Sloan | |
| 6,751,963 | B2 | 6/2004 | Navedo et al. | |

* cited by examiner

*Primary Examiner*—William E Tapolcai
(74) *Attorney, Agent, or Firm*—Advantia Law Group; Michael W. Starkweather; Jason P. Webb

(57) ABSTRACT

A novel portable insulated cooler unit at least includes: a plurality of coolant lines embedded in a plurality of walls of the cooler unit, the coolant lines at least including coolant fluid; a compressor coupled to the coolant lines; a fan adapted to circulate air around the coolant lines; a thermostat adapted to measure the cooler unit internal temperature; a temperature adjust control coupled to the compressor and to the thermostat, the temperature adjust control adapted to cause the cooler unit internal temperature to be adjusted; an AC power supply adapted to receive AC power when available; a DC power jack adapted to receive DC power when available; a rechargeable battery coupled to the AC power supply and to the DC power jack, the rechargeable battery adapted to operate the compressor and the fan when the cooler unit is ON, and the cooler unit is not receiving external power; and a foldable solar panel at least including a photovoltaic array, the solar panel adapted to be functionally stored when folded into the top of the cooler unit, and conduct electricity when exposed to sunlight, and the solar panel adapted to connect via a power cord to the DC power jack and power the cooler unit.

15 Claims, 2 Drawing Sheets

SOLAR POWERED CHILLED COOLER

BACKGROUND OF THE INVENTION

1. Field of the Invention

The present invention generally relates to portable coolers and the like.

2. Description of the Related Art

Until recently, most prior art coolers used for the purpose of maintaining cool temperatures for food and the like were nothing more than insulated chests. This limited both the temperature at which items could be stored and the duration that items could be effectively be stored prior to spoilage. Recent active cooler systems are more in the nature of portable refrigerators, allowing the coolers to be plugged into electrical outlets, or automobile and boat electrical accessory receptacles. This allows for true portable refrigeration. However, these systems cannot work as intended when no electrical outlets or receptacles are available, such as at many camping, fishing, picnic, and general rural sites. Further, these systems can be draining on vehicle batteries when the vehicle motors are not running (which leads to undesirable fuel consumption).

What is needed is a portable refrigeration type cooler that need not rely upon electrical outlets and receptacles for power when outdoors.

SUMMARY OF THE INVENTION

The present invention has been developed in response to the present state of the art, and in particular, in response to the problems and needs in the art that have not yet been fully solved. Accordingly, the present invention has been developed to provide a novel portable insulated cooler unit that at least includes: a plurality of coolant lines embedded in a plurality of walls of the cooler unit, the coolant lines at least including coolant fluid; a compressor coupled to the coolant lines; a fan adapted to circulate air around the coolant lines; a thermostat adapted to measure the cooler unit internal temperature; a temperature adjust control coupled to the compressor and to the thermostat, the temperature adjust control adapted to cause the cooler unit internal temperature to be adjusted; an AC power supply adapted to receive AC power when available; a DC power jack adapted to receive DC power when available; a rechargeable battery coupled to the AC power supply and to the DC power jack, the rechargeable battery adapted to operate the compressor and the fan when the cooler unit is ON, and the cooler unit is not receiving external power; and a foldable solar panel at least including a photovoltaic array, the solar panel adapted to be functionally stored when folded into the top of the cooler unit, and conduct electricity when exposed to sunlight, and the solar panel adapted to connect via a power cord to the DC power jack and power the cooler unit.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figures 1A, 1B, 1C, 1D:
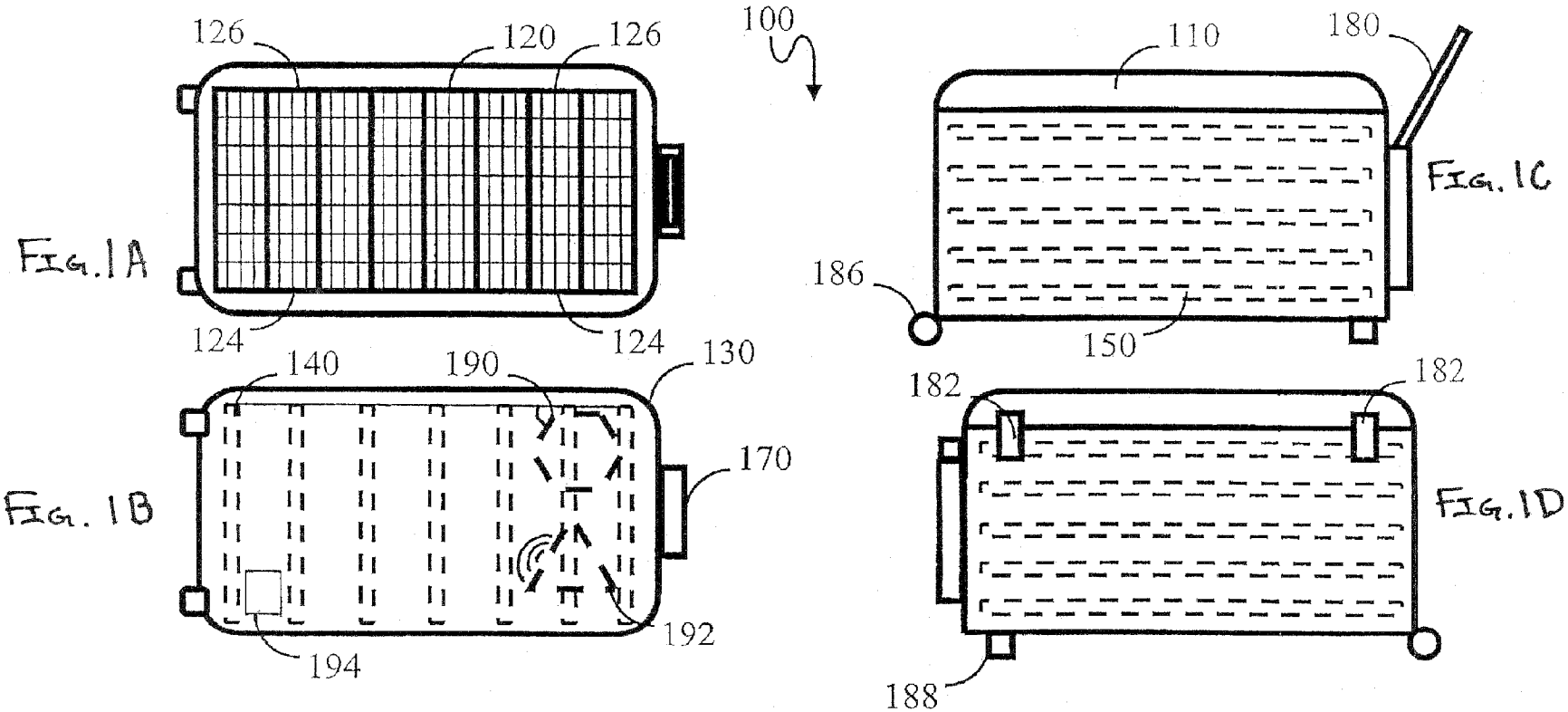
FIG. 1 contains top, bottom, front and rear views of the present-inventive portable cooler unit.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment.

The present-inventive portable cooler unit 100 is illustrated in FIG. 1 starting from the upper left-hand corner and moving counterclockwise, with: a top view; a bottom view; a rear view; and a front view. The cooler unit 100 has an expandable solar panel 120 which can be unfolded to provide a large surface area for collecting sunlight when desirable. The foldable solar panel 120 has interference fit hinges 126 which allow the solar panel to be removed entirely when desired, and also allow the solar panel to swivel/pivot when desired. The cooler also contains solar panel retainers 124 for retaining the solar panel in the stored position on top of the cooler unit 10 when desired. Many configurations are possible for the retainers, including simple interference fit snaps.

The insulated walls 130 of the cooler unit 100 contain embedded coolant lines 140, 150 and 160, which contain suitable cooling fluid. A compressor 190 and fan 192 operate in a manner known in the art to circulate air past the coolant lines. An internal temperature sensor 194 measures the internal temperature of the cooler unit. A side unit 170 contains a rechargeable battery 172 (not shown), a thermostat 174 connected to the temperature sensor for regulating the cooler unit internal temperature, and AC and DC jacks 176 and 178. The AC power jack is connected to an internal power supply (not shown).

Figure 2B:
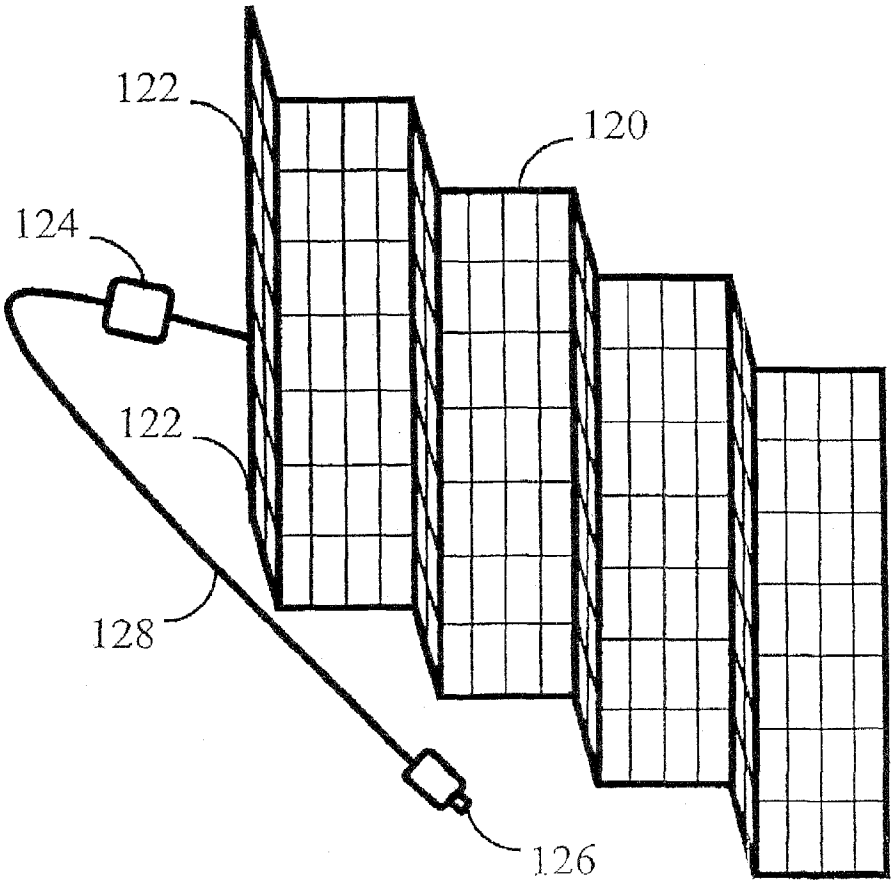
FIG. 2 contains a side view of the present-inventive portable cooler unit, as well as a more detailed view of the solar panel of the present-inventive portable cooler unit.
Figure 2A:
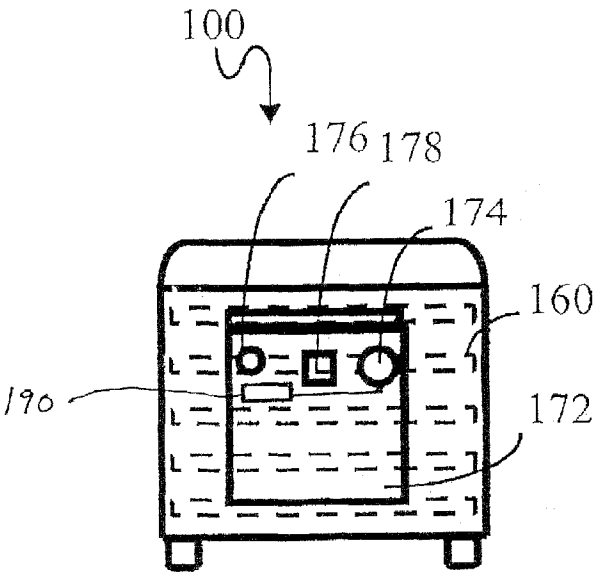

The DC power jack 176 can be connected to a DC power supply as is known in the art, or it can be connected to the solar panel 120, which is more fully detailed in FIG. 2. As can be seen in FIG. 2, the solar panel 120 has a number of photovoltaic arrays 122. A power cord 128 connects the solar panel 120 to the DC jack 176 via a connector 126. In the preferred embodiment, the power cord 128 also has a voltage regulator 124 that prevents battery overcharging. The solar panel can be fully or partially expanded when separated from the cooler unit. The power cord can be wrapped around a collar (not shown) on the rear of the cooler unit to prevent it from unnecessarily hanging from the cooler unit when the solar panel is either folded into the cooler unit top, or close to the cooler unit.

The top/lid 110 of the cooler unit 100 is connected to the cooler unit walls 130 via hinges 182. Also, a retractable handle 180 allows the cooler unit to be conveniently pulled on wheels 186. When the cooler unit is not being pulled, rests 188 compensate for the wheel displacement to provide level stationing of the cooler unit.

Thus, operation of the present-inventive cooler unit 100 can be by solar power, battery power, AC power (where available), or DC power (where available).

It is understood that the above-described preferred embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

It is expected that there could be numerous variations of the design of this invention.

Finally, it is envisioned that the components of the device may be constructed of a variety of materials.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A portable insulated cooler unit comprising:

a plurality of coolant lines embedded in a plurality of walls of said cooler unit, said coolant lines comprising coolant fluid;

a compressor coupled to said coolant lines;

a fan adapted to circulate air around said coolant lines;

a temperature sensor adapted to measure the cooler unit internal temperature;

a thermostat coupled to said compressor and to said temperature sensor, said thermostat adapted to cause the cooler unit internal temperature to be adjusted;

an AC power supply adapted to receive AC power when available;

a DC power jack adapted to receive DC power when available;

a rechargeable battery coupled to said AC power supply and to said DC power jack, said rechargeable battery adapted to operate said compressor and said fan when said cooler unit is ON, and said cooler unit is not receiving external power; and a foldable solar panel comprising a photovoltaic array, said solar panel adapted to be functionally stored when folded into the top of said cooler unit, and conduct electricity when exposed to sunlight, and said solar panel adapted to connect via a power cord to said DC power jack and power said cooler unit.

2. The cooler unit of claim 1, wherein said power cord further comprises a voltage regulator adapted to regulate the voltage output by said solar panel.

3. The cooler unit of claim 1, wherein said top further comprises solar panel retainers adapted to retain said solar panel in a folded position when desired.

4. The cooler unit of claim 1, wherein said solar panel is operationally detachable from said cooler unit.

5. The cooler unit of claim 1, wherein said solar panel is adapted to conduct electricity via an exposed panel, when said solar panel is foldably stored in the top of said cooler unit and exposed to sunlight.

6. A portable insulated cooler unit consisting essentially of:

a plurality of coolant lines embedded in a plurality of walls of said cooler unit, said coolant lines consisting essentially of coolant fluid;

a compressor coupled to said coolant lines;

a fan adapted to circulate air around said coolant lines;

a temperature sensor adapted to measure the cooler unit internal temperature;

a thermostat coupled to said compressor and to said temperature sensor, said thermostat adapted to cause the cooler unit internal temperature to be adjusted;

an AC power supply adapted to receive AC power when available;

a DC power jack adapted to receive DC power when available;

a rechargeable battery coupled to said AC power supply and to said DC power jack, said rechargeable battery adapted to operate said compressor and said fan when said cooler unit is ON, and said cooler unit is not receiving external power; and a foldable solar panel consisting essentially of a photovoltaic array, said solar panel adapted to be functionally stored when folded into the top of said cooler unit, and conduct electricity when exposed to sunlight, and said solar panel adapted to connect via a power cord to said DC power jack and power said cooler unit.

7. The cooler unit of claim 6, wherein said power cord further consists essentially of a voltage regulator adapted to regulate the voltage output by said solar panel.

8. The cooler unit of claim 6, wherein said top further consists essentially of solar panel retainers adapted to retain said solar panel in a folded position when desired.

9. The cooler unit of claim 6, wherein said solar panel is operationally detachable from said cooler unit.

10. The cooler unit of claim 6, wherein said solar panel is adapted to conduct electricity via an exposed panel, when said solar panel is foldably stored in the top of said cooler unit and exposed to sunlight.

11. A portable insulated cooler unit consisting of:

a plurality of coolant lines embedded in a plurality of walls of said cooler unit, said coolant lines consisting of coolant fluid;

a compressor coupled to said coolant lines;

a fan adapted to circulate air around said coolant lines;

a temperature sensor adapted to measure the cooler unit internal temperature;

a thermostat coupled to said compressor and to said temperature sensor, said thermostat adapted to cause the cooler unit internal temperature to be adjusted;

an AC power supply adapted to receive AC power when available;

a DC power jack adapted to receive DC power when available;

a rechargeable battery coupled to said AC power supply and to said DC power jack, said rechargeable battery adapted to operate said compressor and said fan when said cooler unit is ON, and said cooler unit is not receiving external power; and a foldable solar panel consisting of a photovoltaic array, said solar panel adapted to be functionally stored when folded into the top of said cooler unit, and conduct electricity when exposed to sunlight, and said solar panel adapted to connect via a power cord to said DC power jack and power said cooler unit.

12. The cooler unit of claim 11, wherein said power cord further consists of a voltage regulator adapted to regulate the voltage output by said solar panel.

13. The cooler unit of claim 11, wherein said top further consists of solar panel retainers adapted to retain said solar panel in a folded position when desired.

14. The cooler unit of claim 11, wherein said solar panel is operationally detachable from said cooler unit.

15. The cooler unit of claim 11, wherein said solar panel is adapted to conduct electricity via an exposed panel, when said solar panel is foldably stored in the top of said cooler unit and exposed to sunlight.

* * * * *